US005149160A

United States Patent [19]

Iida et al.

[11] Patent Number: 5,149,160

[45] Date of Patent: Sep. 22, 1992

[54] PIPE STRUCTURE

[75] Inventors: Giichi Iida, Tokyo; Kazunori Takahashi, Kawagoe, both of Japan

[73] Assignee: Kioritz Corporation, Tokyo, Japan

[21] Appl. No.: 694,739

[22] Filed: May 2, 1991

[30] Foreign Application Priority Data

May 7, 1990 [JP] Japan ..... 2-047511[U]

[51] Int. Cl.[5] ..... B65G 9/00

[52] U.S. Cl. ..... 294/16; 239/525

[58] Field of Search ..... 294/16, 28, 31.2; 158/107; 239/154, 525; 222/465.1; 16/110 R, 114 R

[56] References Cited

U.S. PATENT DOCUMENTS

| | | | |
|---|---|---|---|
| 1,058,926 | 4/1913 | Toole | 294/16 X |
| 3,586,238 | 6/1971 | Schmierer et al. . | |
| 3,800,370 | 4/1974 | Courtright | 294/31.2 X |
| 4,225,103 | 9/1980 | Pate | 138/107 X |
| 4,269,571 | 5/1981 | Shikutani et al. . | |
| 4,511,167 | 4/1985 | Kawaguchi | 294/28 |
| 4,768,403 | 9/1988 | Bar-Noy | 294/28 X |
| 4,838,465 | 6/1989 | Metzger | 294/16 X |

FOREIGN PATENT DOCUMENTS

| | | |
|---|---|---|
| 52-52574 | 4/1977 | Japan . |
| 54-23881 | 2/1979 | Japan . |
| 151477 | 10/1983 | Japan . |

*Primary Examiner*—Margaret A. Focarino
*Assistant Examiner*—Dean J. Kramer
*Attorney, Agent, or Firm*—Browdy and Neimark

[57] ABSTRACT

A pipe structure comprises a handle member formed as an integral molded part which is divided into two half bodies along the axial direction of a pipe member, a hinge portion being connected between the opposite edges of the half bodies which are combined by bending at the hinge portion so as to be mounted around the pipe member.

1 Claim, 3 Drawing Sheets

PIPE STRUCTURE

BACKGROUND OF THE INVENTION

The present invention relates to a pipe structure comprising a pipe member and a handle member provided on the pipe member for supporting it, wherein the position of the handle member relative to the pipe member in the lengthwise direction can be adjusted to a desired portion.

This type of pipe structure is used as a nozzle pipe for a chemical sprayer or the like. The pipe structure is employed for adjusting the position of the handle member relative to the pipe member of a nozzle pipe or the like according to the spraying height and the stature of the operator. However, since conventional pipe structures each comprise a handle member provided on a pipe member by means of a fixing band member which is separated from the handle member, the conventional pipe structures have disadvantages with respect to the need of many components, many processing and assembling steps and the relatively high cost. The structures also have the disadvantage that the adjusting work requires much time because the clamp screw of the fixing band portion must be loosened by using a tool when the position of the handle member is adjusted.

SUMMARY OF THE INVENTION

Accordingly, the present invention has been achieved for removing the disadvantages of the prior art, and it is an object of the present invention to provide a pipe structure of the above-described type comprising a member which corresponds to the fixing band of a conventional pipe structure and which is formed integrally with a handle member whose position can be easily adjusted without using a tool for loosening a clamp screw.

Namely, in the present invention, the pipe structure of the above type comprises a pipe member and a handle member provided on the pipe member for supporting it in such a manner that the position of the handle member in the lengthwise direction relative to the pipe member can be adjusted to a desired position, wherein the handle member is a molded-in part which is divided into two half bodies along the axial direction of the pipe member, a hinge portion is connected between the opposite side edges of the half bodies, the two half bodies are combined by bending at the hinge portion so as to be mounted around the pipe member One of the half bodies of the handle member is mounted on the pipe member, and the other half body is combined with the one half body by bending at the hinge portion so that the handle member can be securely mounting around the pipe member. The present invention therefore enables the formation of a pipe structure at low cost which has a small number of parts and which can be formed by a small number of processing and assembling steps.

DESCRIPTION OF PREFERRED EMBODIMENT OF THE INVENTION

Figure 1:
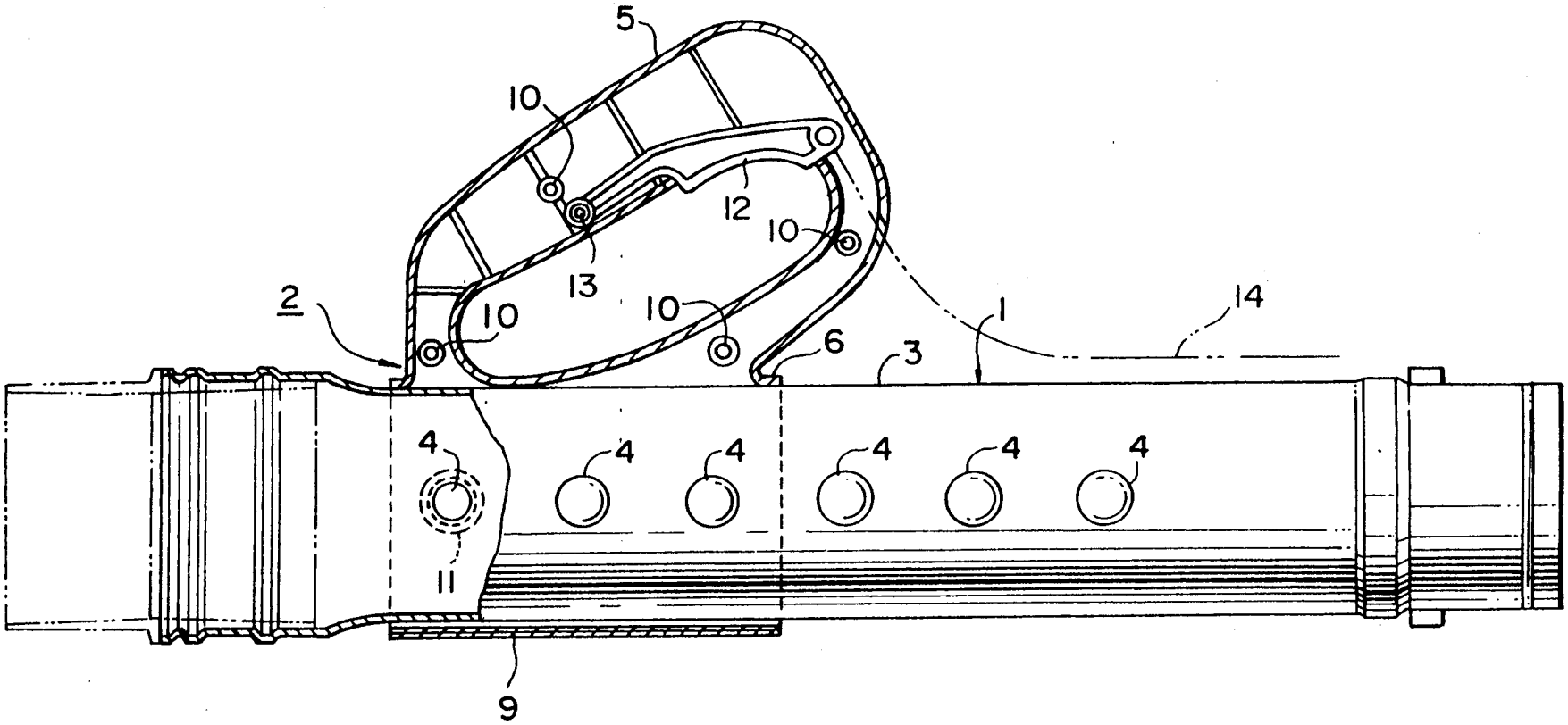
FIG. 1 is a partially broken-out side view showing a pipe structure in accordance with an embodiment of the present invention.

The present invention is described below with reference to the embodiment shown in the drawings.

Figure 2:
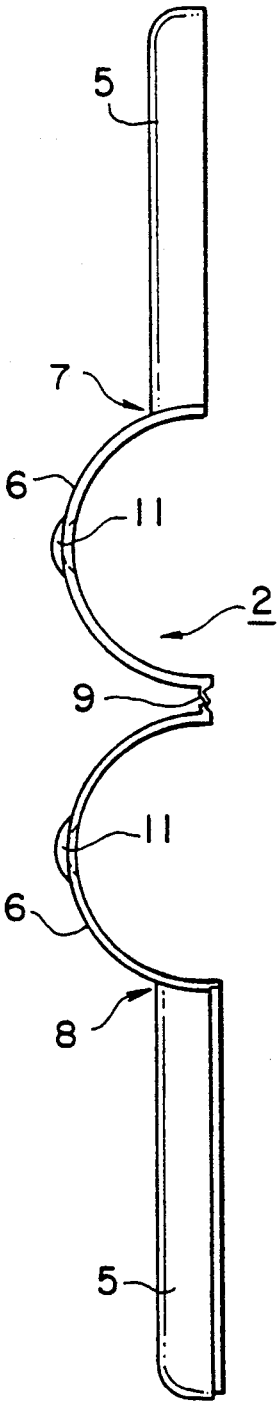
FIG. 2 is an exploded end view of the handle member of the pipe structure shown in FIG. 1.
Figure 4:
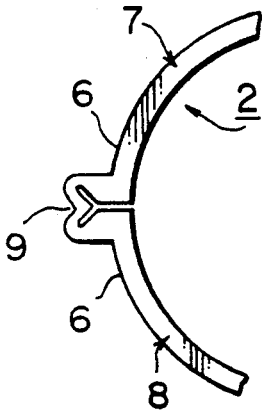
FIG. 4 is an enlarged end view of a hinge portion of the handle member of the pipe structure shown in FIG. 1.
Figure 3:
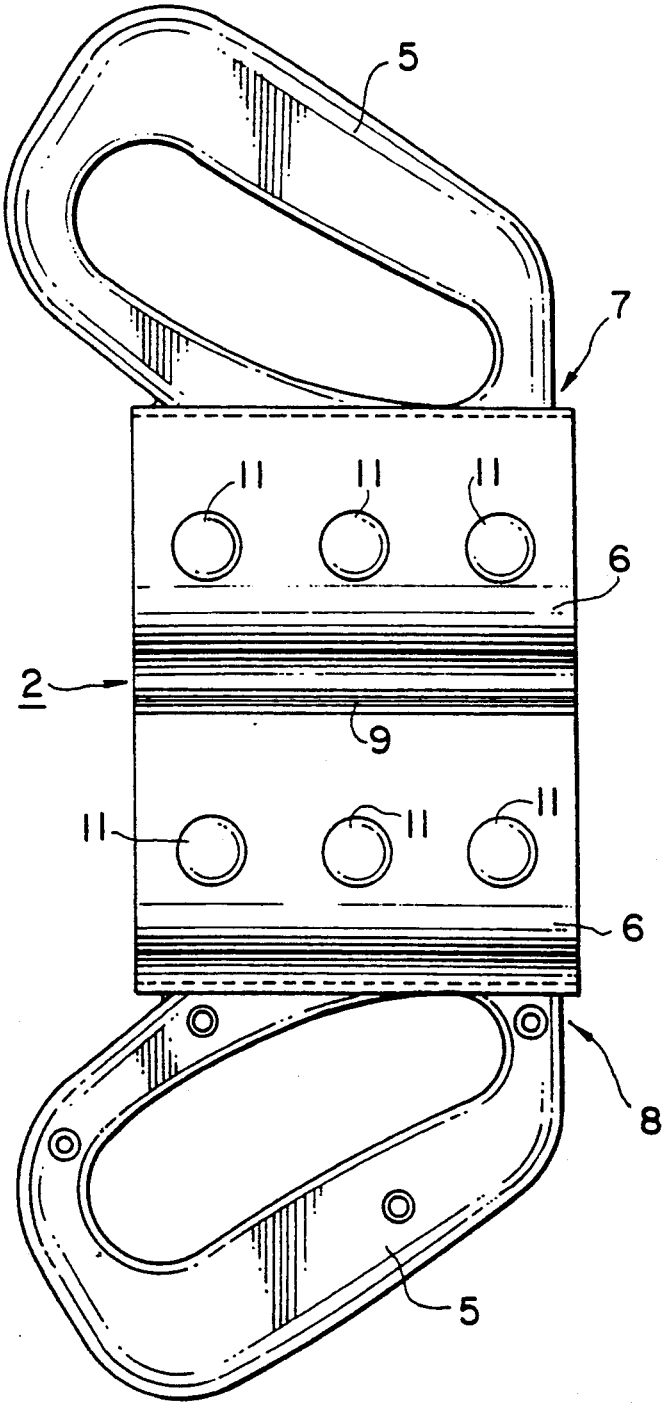
FIG. 3 is an exploded side view of the same handle member of the pipe structure shown in FIG. 1.

The embodiment shown in the drawings is applied to the nozzle pipe of an air blowing cleaner or a chemical sprayer. As shown in FIG. 1, the pipe structure in this embodiment has a pipe member 1 which forms a nozzle pipe and a handle member 2 provided on the pipe member 1. The pipe member 1 is made of an appropriate material such as a metal, a synthetic resin or the like. The pipe member 1 also has a plurality (in this embodiment, six) of semi-spherical outwardly protruding portions 4 which are provided at predetermined intervals on both sides of the outer periphery 3 of the pipe member 1 in the lengthwise direction thereof and which are formed integrally with the pipe member 1. On the other hand, the handle member 2 is formed by appropriate molding using a synthetic resin and has a handle portion 5 which is held by the operator and a fixing band portion 6 which is mounted around the outer periphery of the pipe member 1, both of which are formed integrally with the handle member 2. As shown in FIGS. 2 and 3, the handle member 2 is half divided into two half bodies 7 and 8, which are integrally formed, along the plane passing through the center of the handle portion 5 and including the axial line of the fixing band portion 6 in the axial direction of the pipe member 1. The two half portions 7 and 8 are connected with each other by a hinge portion 9 which is integrally formed at the side edges of the half bodies 7, 8 opposite to the side of the handle portion 5. The half bodies 7, 8 and the hinge portion 9 are formed as an integral molded part. The hinge portion 9 has a relatively small thickness and a W-shaped form with a recess on the outside thereof. The hinge portion 9 having such a form has appropriate levels of flexibility and cushioning properties and permits the two half bodies 7 and 8 to be easily combined with each other by bending at the hinge portion 9, as shown in FIGS. 1 and 4, so that the fixing band portion 6 can be tightly disposed on the outer periphery 3 of the pipe member 1, and the handle portion 5 can be formed. Each of the two half bodies 7 and 8 has a plurality of tapped holes 10 which are formed in the handle portion 5 so that the tapped holes 10 in the two half bodies 7 and 8 are matched with each other when the half bodies are combined. A screw (not shown) is screwed into each of the tapped holed 10 to securely fix the handle member 2 to the outer periphery 3 of the pipe member 1. The handle member 2 also has a plurality (in this embodiment, three) of semi-spherical recesses 11 which are formed at predetermined intervals on a line in the inner surface of each of the half bodies 7 and 8 in the lengthwise direction thereof. The recesses 11 are disposed at the same intervals as those of the protruding portions 4 on the outer periphery 3 of the pipe member 1 corresponding to the protruding portions 4 on a line. When the handle member 2 is mounted on the pipe member 1, as shown in FIG. 1, the recesses 11 of the handle member 2 can be respectively engaged with the protruding portions 4 on both sides of the pipe member 1.

When the handle member 2 mounted on the pipe member 1 in the above manner is moved to a desired position in the lengthwise direction of the pipe member 1, a force which is slightly stronger than the force acting during usual working is applied by the operator to the handle member 2 in the moving direction. During this time, although a resistance force is produced by the engagement between the protruding portions 4 of the pipe member 1 and the recesses 11 of the handle member 2, the W-shaped hinge portion 9 extends in the peripheral direction of the fixing band portion 6 of the handle member 2 so as to outwardly extend the fixing band portion 6 to some extent in the radial direction thereof. The recesses 11 of the handle member 2 can thus be easily separated from the protruding portions 4 of the pipe member 1, and the handle member 2 can be moved to a desired portion at which the protruding portions 4 are again engages with the recesses 11, and the handle member 2 is held on the pipe member 1. In this way, the position of the handle member 2 can be rapidly, easily adjusted by making use of the flexibility and cushioning properties of the hinge portion 9, without loosening screws or the like or using a tool.

In FIG. 1, reference numeral 12 denotes a control trigger pivotally supported by a pivot shaft 13 in the handle portion 5 so as to control an opening adjusting means or the like (not shown) provided at the tip portion of the pipe member 1 through a Bowden cable 14.

What is claimed is:

1. A pipe structure comprising a pipe member and a handle member provided on said pipe member for supporting it in such a manner that the position of said handle member relative to said pipe member in the lengthwise direction can be adjusted to a desired position, and said handle member is formed as an integral molded part which is divided into two half bodies along the axial direction of said pipe member, a hinge portion is connected between opposite side edges of said half bodies, and said two half bodies are combined to each other by bending at said hinge portion so that said handle member is mounted around said pipe member wherein said handle member has a plurality of semi-spherical recesses formed at certain intervals on a line in an inner surface of each of said two half bodies in the lengthwise direction thereof, said recesses being arranged to engage corresponding protruding portions formed at intervals on a line on the outer periphery of said pipe member.

* * * * *